US008284220B2

(12) United States Patent
Takayama et al.

(10) Patent No.: US 8,284,220 B2
(45) Date of Patent: Oct. 9, 2012

(54) IMAGE ERASING APPARATUS AND IMAGE FORMING APPARATUS

(75) Inventors: Satoshi Takayama, Kawasaki (JP); Takeshi Gotanda, Yokohama (JP); Yumiko Sekiguchi, Kawasaki (JP); Kenji Sano, Tokyo (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 35 days.

(21) Appl. No.: 13/041,596

(22) Filed: Mar. 7, 2011

(65) Prior Publication Data

US 2012/0056962 A1 Mar. 8, 2012

(30) Foreign Application Priority Data

Sep. 2, 2010 (JP) ..... 2010-197043

(51) Int. Cl.
*B41J 2/32* (2006.01)

(52) U.S. Cl. ..... 347/171; 347/179

(58) Field of Classification Search ..... 347/171, 347/179

See application file for complete search history.

(56) References Cited

U.S. PATENT DOCUMENTS 6,329,317 B1 12/2001 Takayama et al.
2004/0169713 A1* 9/2004 Niino et al. ..... 347/171
2005/0191082 A1 9/2005 Takayama et al.
2010/0021840 A1 1/2010 Sano et al.
2010/0315475 A1* 12/2010 Taki et al. ..... 347/179

FOREIGN PATENT DOCUMENTS

JP 2010-077376 4/2010

OTHER PUBLICATIONS

Takayama et al, Highly Effective Image Eraser for Decolorable Toner, Journal of Imaging Science and Technology 50(b), pp. 516-521, 2006.

* cited by examiner

*Primary Examiner* — Huan Tran
(74) *Attorney, Agent, or Firm* — Turocy & Watson, LLP

(57) ABSTRACT

According to one embodiment, an image erasing apparatus decolors an image printed on a paper sheet using an ink containing at least a leuco dye, a developer, water, a water-soluble organic solvent, and a surfactant. The image erasing apparatus includes a heating unit, a feedback mechanism, and a control unit. The heating unit heats the paper sheet. The feedback mechanism supplies the paper sheet heated by the heating unit to the heating unit again. The control unit causes the feedback mechanism to supply the paper sheet to the heating unit a plurality of times so as to heat the paper sheet a plurality of times.

8 Claims, 10 Drawing Sheets

IMAGE ERASING APPARATUS AND IMAGE FORMING APPARATUS

CROSS-REFERENCE TO RELATED APPLICATIONS

This application is based upon and claims the benefit of priority from Japanese Patent Application No. 2010-197043, filed on Sep. 2, 2010; the entire contents of which are incorporated herein by reference.

FIELD

Embodiments described herein relate generally to an image erasing apparatus and an image forming apparatus including an image erasing apparatus.

BACKGROUND

Efficiently using paper resources is a recent large challenge to protect the global environment and suppress the greenhouse effect caused by $CO_2$. There exist "reuse" techniques for efficient utilization of paper resources. One of the reuse techniques includes printing an image on a paper sheet (image recording medium) using an erasable ink and then heating the paper sheet to erase (decolor) the image. When an image is printed again on the paper sheet that has undergone the image erase, a density change (so-called memory phenomenon) may occur in the erased image portion.

DETAILED DESCRIPTION

In general, according to one embodiment, an image erasing apparatus decolors an image printed on a paper sheet using an ink containing at least a leuco dye, a developer, water, a water-soluble organic solvent, and a surfactant. The image erasing apparatus includes a heating unit, a feedback mechanism, and a control unit. The heating unit heats the paper sheet. The feedback mechanism supplies the paper sheet heated by the heating unit to the heating unit again. The control unit causes the feedback mechanism to supply the paper sheet to the heating unit a plurality of times so as to heat the paper sheet a plurality of times.

An embodiment will now be described with reference to the accompanying drawings.

Figure 1:
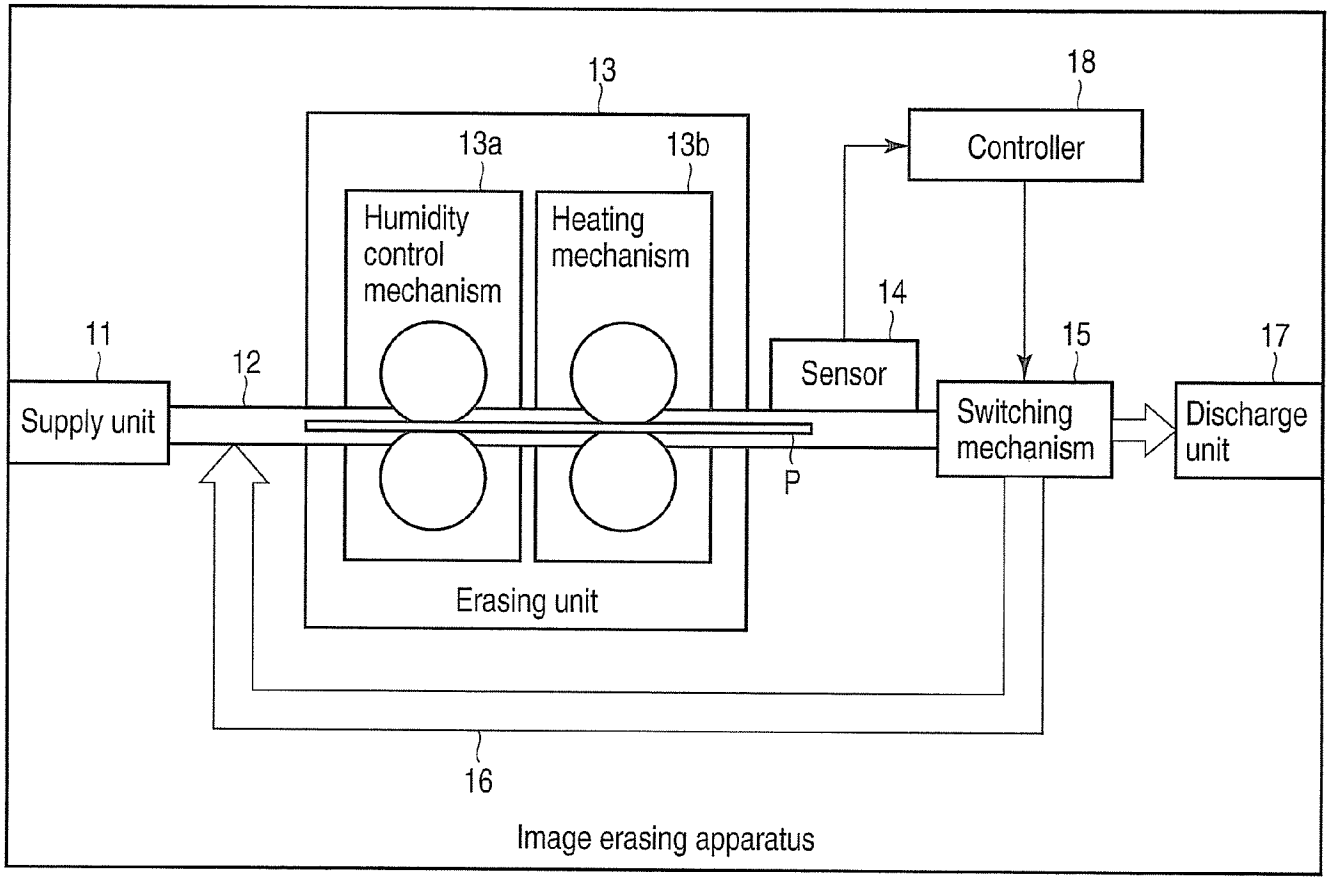
FIG. 1 is a block diagram conceptually showing an arrangement example of an image erasing apparatus.

FIG. 1 is a block diagram conceptually showing an arrangement example of an image erasing apparatus according to the embodiment.

As shown in FIG. 1, an image erasing apparatus 10 includes a supply unit 11, a main conveyance path 12, an erasing unit 13, a sensor 14, a switching mechanism 15, a feedback conveyance path 16, a discharge unit 17, and a controller 18.

The main conveyance path 12 conveys a paper sheet P serving as an image erase target. The main conveyance path 12 conveys the paper sheet P from the supply unit 11 to the discharge unit 17. For example, the main conveyance path 12 picks up one paper sheet from, for example, a paper tray serving as the supply unit 11. The main conveyance path 12 conveys the paper sheet P from the supply unit 11 to the erasing unit 13. The main conveyance path 12 conveys the paper sheet P that has passed through the erasing unit 13 to the sensor 14. The main conveyance path 12 conveys the paper sheet P that has passed through the sensor 14 to a paper storage unit serving as the discharge unit 17 via the switching mechanism 15.

The erasing unit 13 includes a heating mechanism 13*b* that heats the paper sheet P. The heating mechanism 13*b* heats the paper sheet P conveyed on the main conveyance path 12. The heating mechanism 13*b* need only heat paper. For example, a heat roller, a thermal bar, or a thermal head is applicable to the heating mechanism 13*b*. The erasing unit 13 may include a humidity control mechanism 13*a* at the preceding stage of the heating mechanism 13*b*. The humidity control mechanism 13*a* need only humidify the paper sheet P. For example, a humidity control roller is applicable to the humidity control mechanism 13*a*.

The sensor 14 detects the image density on the paper sheet P. The sensor 14 outputs data representing the image density on the paper sheet P to the controller 18. The sensor 14 is, for example, an optical sensor which is formed from a light source and a photoelectric conversion unit. The optical sensor serving as the sensor 14 detects the image density on the sheet surface based on light reflected by the sheet surface.

The switching mechanism 15 selects the conveyance direction of the paper sheet P. The switching mechanism 15 serves as a branch gate which switches the conveyance direction of the paper sheet P that has passed through the sensor 14 so as to convey it to the feedback conveyance path 16 or the discharge unit 17. The switching mechanism 15 guides a paper sheet that should be conveyed to the erasing unit 13 again to the feedback conveyance path 16, and a paper sheet that should be discharged to the discharge unit. The switching mechanism 15 is controlled by the controller 18. The feedback conveyance path 16 conveys the paper sheet that has passed through the sensor 14 to the erasing unit 13 again.

The controller 18 controls the entire image erasing apparatus 10. The controller 18 includes a processor, a recording device, and the like. The controller 18 causes the processor to execute programs stored in the recording device, thereby implementing various functions. For example, the controller 18 has a function of controlling the switching mechanism 15 based on data detected by the sensor 14. The controller 18 determines based on the image density detected by the sensor 14 whether to convey the paper sheet to the erasing unit 13 again. Upon determining to convey the paper sheet to the erasing unit 13 again, the controller 18 causes the switching mechanism 15 to guide the paper sheet to the feedback conveyance path 16, thereby conveying the paper sheet to the erasing unit 13.

Arrangement examples of the internal structure of the image erasing apparatus will be described next.

Figure 2:
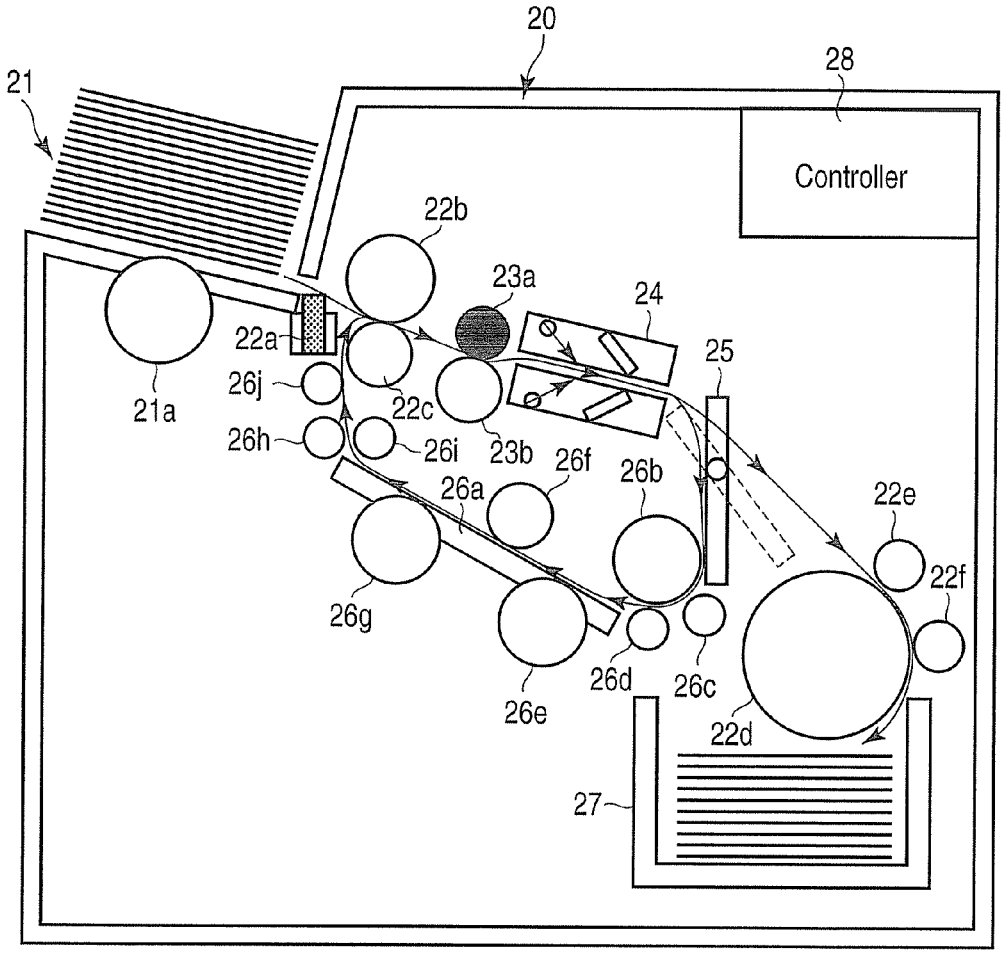
FIG. 2 is a view showing the first arrangement example of the internal structure of an inline image erasing apparatus.

FIG. 2 is a view showing the first arrangement example of the internal structure of an inline image erasing apparatus 20.

The image erasing apparatus 20 of the first arrangement example shown in FIG. 2 includes a paper stocker 21, a microswitch 22*a*, conveyance rollers 22*b* to 22*f*, a heating roller pair 23, a reflectance measuring system 24, a sorting guide 25, a paper guide 26*a*, conveyance rollers 26*b* to 26*j*, a paper holder 27, and a controller 28.

The paper stocker 21 functions as the supply unit 11. Paper sheets (used paper sheets) to be subjected to image erase are stacked on the paper stocker 21. The paper stocker 21 has an extraction roller 21*a*. The extraction roller 21*a* is installed under the paper stocker 21. The extraction roller 21*a* feeds the paper sheets in the paper stocker 21 into the image erasing apparatus 20 one by one sequentially from the lowermost paper sheet (the paper sheet that has been set first). The microswitch 22*a* detects the presence/absence of a paper sheet conveyed from the paper stocker 21. The microswitch 22*a* is installed near the inlet of the paper stocker 21. If the microswitch 22*a* has detected the "presence" of a paper sheet, the controller 18 starts image erase processing for the paper sheet fed from the paper stocker 21.

The paper sheet detected by the microswitch 22*a* is conveyed to the heating roller pair 23 by the conveyance rollers 22*b* and 22*c* that form part of the main conveyance path 12. The heating roller pair 23 forms the erasing unit 13. The heating roller pair 23 also functions as part of the main conveyance path 12. The heating roller pair 23 includes heat rollers and, more specifically, a heating roller 23*a* and a counter roller 23*b*. The heating roller pair 23 heats the paper sheet to be conveyed to the main conveyance path 12. The paper sheet heated by the heating roller pair 23 is conveyed to the reflectance measuring system 24. The heating roller pair 23 serving as heat rollers may be replaced with another mechanism for heating a paper sheet. For example, the image erasing apparatus 20 may include a thermal bar or a thermal head in place of the heating roller pair (heat rollers) 23. Note that the heating temperature of the heating roller pair 23 is, for example, 140 to 250° C.

The reflectance measuring system 24 functions as the sensor 14. The reflectance measuring system 24 measures, for example, the reflectance (the value representing the image density) on the entire surface of the paper sheet and outputs data representing the measured reflectance to the controller 28. The reflectance measuring system 24 may measure detection data representing the maximum value of the afterimage density on the sheet surface. In the arrangement example shown in FIG. 2, the reflectance measuring system 24 has an arrangement for measuring the reflectance on both surfaces of the paper sheet conveyed through the main conveyance path 12.

The sorting guide 25 functions as the switching mechanism 15. The sorting guide 25 is a branch gate driven under the control of the controller 28. The sorting guide 25 selectively guides the paper sheet that has passed through the reflectance measuring system 24 to a feedback conveyance path 16 or the discharge unit 17. For example, the sorting guide 25 guides the paper sheet to the paper guide 26*a* serving as the feedback conveyance path in the state indicated by the solid line in FIG. 2. The sorting guide 25 guides the paper sheet to the paper holder 27 serving as the discharge unit in the state indicated by the dotted line in FIG. 2.

The paper guide 26*a* and the conveyance rollers 26*b* to 26*j* form the feedback conveyance path 16. The paper guide 26*a* and the conveyance rollers 26*b* to 26*j* convey the paper sheet from the sorting guide 25 to the heating roller pair 23. The conveyance rollers 22*d* to 22*f* form part of the main conveyance path 12. The conveyance rollers 22*d* to 22*f* convey the paper sheet from the sorting guide 25 to the paper holder 27. The paper holder 27 functions as the discharge unit 17 to store paper sheets that have undergone the erase processing.

The controller 28 functions as the controller 18. The controller 28 determines the maximum value of the afterimage density on the sheet surface based on the data from the reflectance measuring system 24. The controller 28 determines whether to return the paper sheet to the heating roller pair 23 based on the result of comparison between a preset threshold D and the maximum value of the afterimage density measured by the reflectance measuring system 24 and the number of times of paper heating by the heating roller pair 23. For example, the controller 28 controls the sorting guide 25 so as to pass the paper sheet to the heating roller pair 23 a predetermined number of times after the maximum value of the afterimage density has exceeded the threshold.

Figure 3:
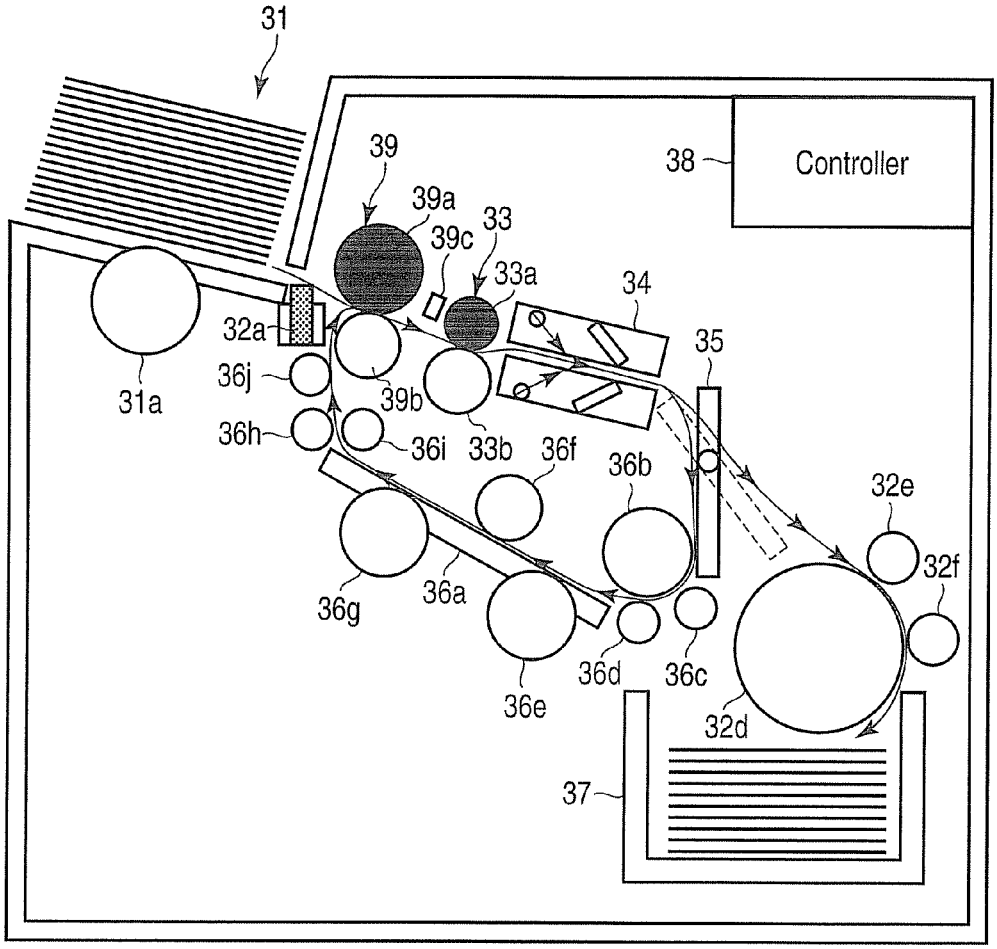
FIG. 3 is a view showing the second arrangement example of the internal structure of an inline image erasing apparatus.

FIG. 3 is a view showing the second arrangement example of the internal structure of an inline image erasing apparatus 30.

The image erasing apparatus 30 of the second arrangement example shown in FIG. 3 includes a paper stocker 31, a microswitch 32*a*, conveyance rollers 32*d* to 32*f*, a heating roller pair 33, a reflectance measuring system 34, a sorting guide 35, a paper guide 36*a*, conveyance rollers 36*b* to 36*j*, a paper holder 37, a controller 38, and a humidity control roller pair 39.

The paper stocker 31, the microswitch 32*a*, the conveyance rollers 32*d* to 32*f*, the heating roller pair 33, the reflectance measuring system 34, the sorting guide 35, the paper guide 36*a*, the conveyance rollers 36*b* to 36*j*, the paper holder 37, and the controller 38 can be implemented by the same components as those of the paper stocker 21, the microswitch 22*a*, the conveyance rollers 22*d* to 22*f*, the heating roller pair 23, the reflectance measuring system 24, the sorting guide 25, the paper guide 26*a*, the conveyance rollers 26*b* to 26*j*, the paper holder 27, and the controller 28 described in the first arrangement example.

The humidity control roller pair 39 humidifies the paper sheet. The humidity control roller pair 39 includes a humidity control roller 39*a* and a counter roller 39*b*. The humidity control roller pair 39 and the heating roller pair 33 form the erasing unit 13. The humidity control roller pair 39 also functions as part of the main conveyance path 12. The humidity control roller pair 39 humidifies the paper sheet to be heated by the heating roller pair 33. In the image erasing apparatus 30 of the second arrangement example, the paper sheet as the image erase target is humidified by the humidity control roller pair 39 and then heated by the heating roller pair 33. Note that the humidity the humidity control roller pair 39 gives the paper sheet is, for example, 10 to 20%.

The image erasing apparatus 30 may include a humidity sensor 39*c* that detects the humidity of the paper sheet. In this case, the controller 38 can control the humidity the humidity control roller pair 39 supplies to the paper sheet. For example, the humidity sensor 39*c* is installed between the humidity control roller pair 39 and the heating roller pair 33. Detection data representing the humidity of the paper detected by the humidity sensor 39*c* is output to the controller 38. Based on the detection data from the humidity sensor 39*c*, the controller 38 may feed back the humidity the humidity control roller pair 39 gives the paper sheet.

Figure 4:
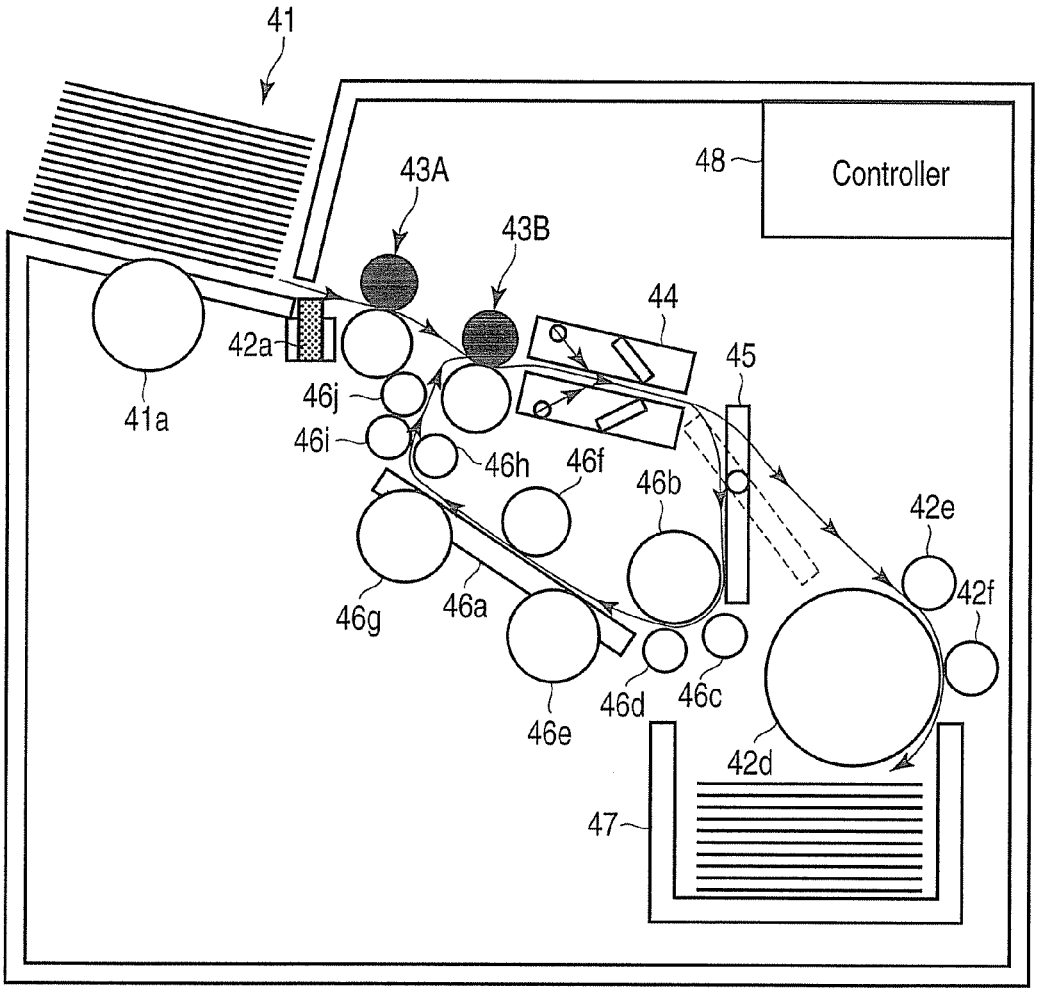
FIG. 4 is a view showing the third arrangement example of the internal structure of an inline image erasing apparatus.

FIG. 4 is a view showing the third arrangement example of the internal structure of an inline image erasing apparatus 40.

The image erasing apparatus 40 of the third arrangement example shown in FIG. 4 includes a paper stocker 41, a microswitch 42*a*, conveyance rollers 42*d* to 42*f*, heating roller pairs 43A and 43B, a reflectance measuring system 44, a sorting guide 45, a paper guide 46*a*, conveyance rollers 46*b* to 46*j*, a paper holder 47, and a controller 48.

The paper stocker 41, the microswitch 42*a*, the conveyance rollers 42*d* to 42*f*, the reflectance measuring system 44, the sorting guide 45, the paper guide 46*a*, the conveyance rollers 46*b* to 46*j*, the paper holder 47, and the controller 48 can be implemented by the same components as those of the paper stocker 21, the microswitch 22*a*, the conveyance rollers 22*d* to 22*f*, the reflectance measuring system 24, the sorting guide 25, the paper guide 26*a*, the conveyance rollers 26*b* to 26*j*, the paper holder 27, and the controller 28 described in the first arrangement example.

The image erasing apparatus 40 of the third arrangement example includes the plurality of heating roller pairs 43A and 43B. The heating roller pairs 43A and 43 form the erasing unit. Each of the heating roller pairs 43A and 43B sequentially heats the paper sheet conveyed through the main conveyance path. Each of the heating roller pairs 43A and 43B may have the same structure as that of the above-described heating roller pair 23. In addition, each of the heating roller pairs 43A and 43B may be replaced with a thermal bar or a thermal head.

In the image erasing apparatus 40 of the third arrangement example, the feedback conveyance path formed from the paper guide 46*a* and the conveyance rollers 46*b* to 46*j* convey the paper sheet that has passed through the reflectance measuring system 44 to the preceding stage of the heating roller pair 43B. The image erasing apparatus 40 of the third arrangement example shown in FIG. 4 reheats only once the paper sheet passed through the reflectance measuring system 44 and conveyed on the feedback conveyance path. This allows the controller 48 to control the paper heat count on an one-by-one basis. However, the feedback conveyance path may convey the paper sheet that has passed through the reflectance measuring system 44 to the preceding stage of the heating roller pair 43A. In this arrangement, the paper sheet passed through the reflectance measuring system 44 and conveyed on the feedback conveyance path is reheated twice. Hence, the controller 48 controls the paper heat count on a two-by-two basis.

Note that an image erasing apparatus may be formed by combining the image erasing apparatus of the second arrangement example and that of the third arrangement example. That is, the erasing unit of the image erasing apparatus may include a humidity control roller pair and a plurality of heating roller pairs.

The arrangement of an image forming apparatus comprising the above-described image erasing apparatus will be described next.

Figure 5:
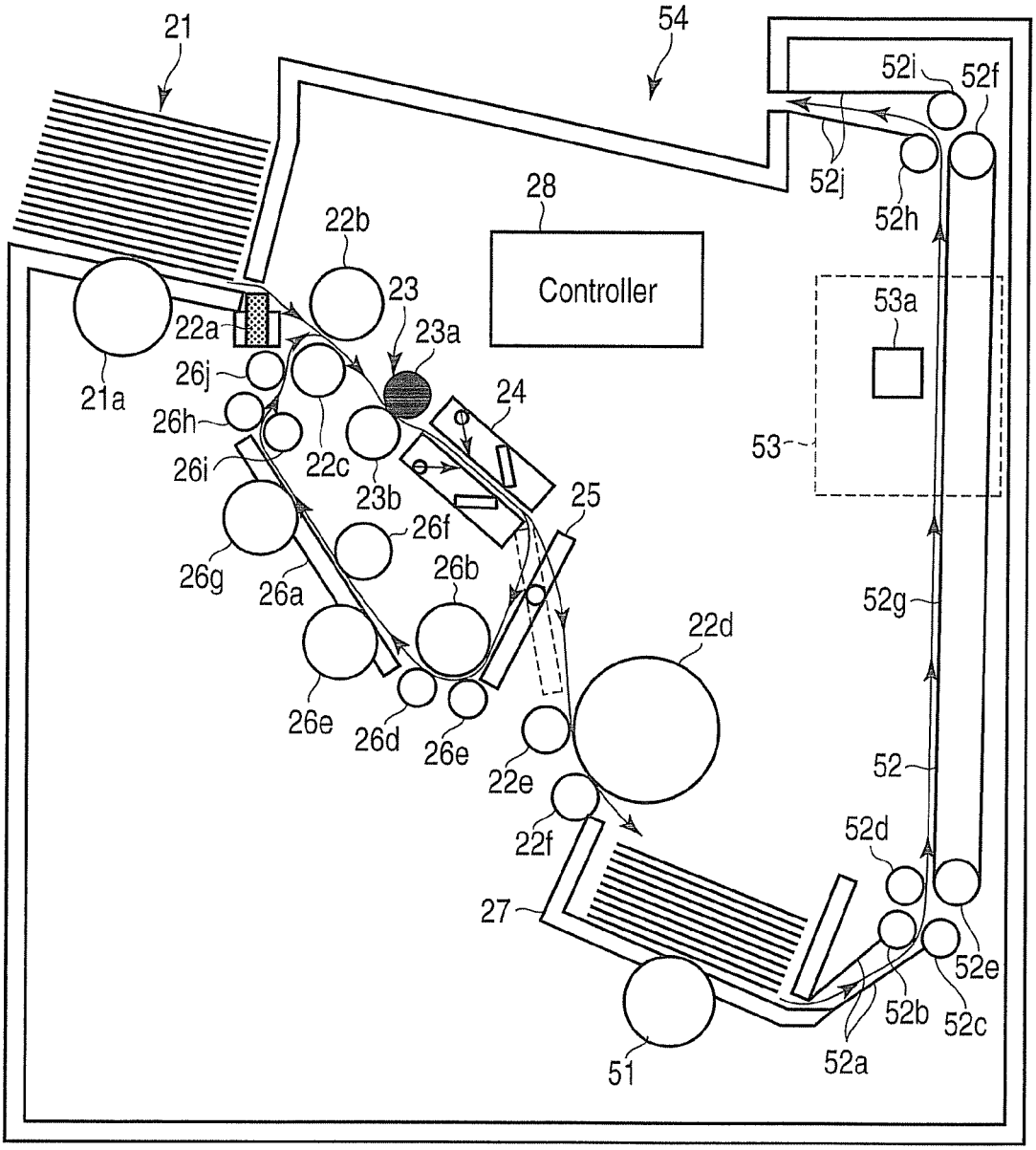
FIG. 5 is a view showing the fourth arrangement example of an image forming apparatus comprising an image erasing apparatus.

FIG. 5 is a view showing an arrangement example of the fourth image forming apparatus 50 comprising the image erasing apparatus 20.

The image forming apparatus 50 shown in FIG. 5 includes the paper stocker 21, the microswitch 22*a*, the conveyance rollers 22*b* to 22*f*, the heating roller pair 23, the reflectance measuring system 24, the sorting guide 25, the paper guide 26*a*, the conveyance rollers 26*b* to 26*j*, the paper holder 27, the controller 28, an extraction roller 51, a printer conveyance system 52, a printer unit 53, and a discharge tray 54.

The paper stocker 21, the microswitch 22*a*, the conveyance rollers 22*b* to 22*f*, the heating roller pair 23, the reflectance measuring system 24, the sorting guide 25, the paper guide 26*a*, the conveyance rollers 26*b* to 26*j*, the paper holder 27, and the controller 28 form the image erasing apparatus 20 of the first arrangement example shown in FIG. 2. However, the paper holder 27 has an outlet to feed a paper sheet. In the arrangement example shown in FIG. 5, the controller 28 also controls the printer conveyance system 52, the printer unit 53, and the like.

In the image forming apparatus 50, the image erasing apparatus 20 stores, in the paper holder 27, paper sheets that have undergone the image erase processing. The paper sheets that have undergone the image erase are stacked on the paper holder 27. The image forming apparatus 50 uses paper sheets stored in the paper holder 27 as paper sheets to form images. The extraction roller 51 is provided under the paper holder 27 to feed the paper sheets from the outlet one by one. The extraction roller 51 extracts the paper sheets in the paper holder 27 one by one sequentially from the lowermost paper sheet (the paper sheet that has undergone the image erase processing first), and feeds the paper sheet from the outlet of the paper holder 27 to the printer conveyance system 52.

The printer conveyance system 52 conveys the paper sheet extracted from the paper holder 27 to the printer unit 53. The printer conveyance system 52 conveys the paper sheet having an image printed by the printer unit 53 to the discharge tray 54. In the arrangement example shown in FIG. 5, the printer conveyance system 52 includes a conveyance guide 52*a*, conveyance rollers 52*b* and 52*c*, a press roller 52*d*, a driven roller 52*e*, a driving roller 52*f*, a conveyor belt 52*g*, conveyance rollers 52*h* and 52*i*, a conveyance guide 52*j*, and the like.

The conveyance guide 52*a* conveys the paper sheet extracted from the paper holder 27 by the extraction roller 51 to the conveyance rollers 52*b* and 52*c*. The conveyance rollers 52*b* and 52*c* convey the paper sheet to the conveyor belt 52*g* at a predetermined timing. The driving roller 52*f* and the driven roller 52*e* apply a tension to the conveyor belt 52*g*. The conveyor belt 52*g* is driven as the driving roller 52*f* rotates. The press roller 52*d* presses the paper sheet P against the conveyor belt 52*g*. The conveyor belt 52*g* has, for example, holes in its surface at a predetermined interval. A negative pressure chamber is arranged inside the conveyor belt 52*g* and connected to a fan so as to cause the conveyor belt 52*g* to draw the paper sheet. The paper sheet is conveyed while being drawn by the conveyor belt 52*g*.

The printer unit 53 prints an image on the paper sheet. The printer unit 53 prints an image on the paper sheet using an ink erasable (decolorable) by the image erasing apparatus 20. The paper sheet having the image printed by the printer unit 53 is conveyed to the discharge tray 54 via the conveyor belt 52*g*, the conveyance rollers 52*h* and 52*i*, and the conveyance guide 52*j*. The printer unit 53 includes an inkjet head 53*a*. The inkjet head 53*a* is designed not to heat the ink to the decoloration temperature or higher.

The inkjet head 53*a* prints an image on the paper sheet conveyed by the conveyor belt 52*g*. The inkjet head 53*a* discharges a decolorable ink. As the decolorable ink, for example, a homogeneous dye ink is used. The homogeneous dye ink is made of a leuco dye, a phenolic developer, alcohols, water, and a surfactant. The homogeneous dye ink is easy to manufacture, inexpensive, and hard to clog.

Note that FIG. 5 illustrates an arrangement example of the image forming apparatus 50 comprising the image erasing apparatus 20. However, the image forming apparatus 50 may comprise the image erasing apparatuses 30 and 40 in place of the image erasing apparatus 20.

The characteristic of the ink to be erased by the image erasing apparatus will be explained next.

The ink to be erased (decolored) by the image erasing apparatus is a homogeneous dye ink. The homogeneous dye ink is made of a leuco dye, a phenolic developer, alcohols, water, and a surfactant. The homogeneous dye ink may cause a density change in an image newly printed at an image portion erased in the past. The phenomenon that a density change occurs in an image portion erased in the past will be referred to as a memory phenomenon.

Figure 6:
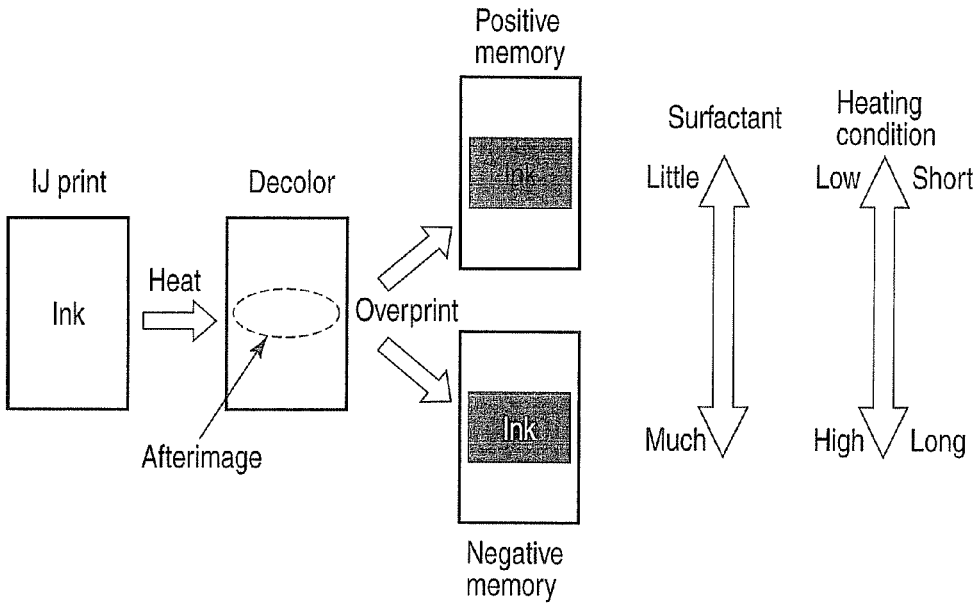
FIG. 6 is a view for explaining a memory phenomenon.

FIG. 6 is a view for explaining the memory phenomenon.

A phenomenon that an image portion printed and erased in the past gets a density greater than that of the peripheral image portion will be referred to as positive memory, and a phenomenon that the image portion gets a lower density will be referred to as negative memory here in after.

As shown in FIG. 6, the afterimage density and the memory density change depending on the ink composition and the heating conditions. The afterimage density is assumed to be the image density of an afterimage portion relative to the image density of a plain portion. The memory density is assumed to be the image density of a memory portion (a portion where an image has been erased) relative to the image density of a peripheral portion.

The less the surfactant in the ink composition is, the more noticeably the positive memory appears. In addition, the less the heat amount of the heating condition is, the more noticeably the positive memory appears. That is, at a predetermined heating temperature, the shorter the heating time is, the more noticeably the positive memory appears. In a predetermined heating time, the lower the heating temperature is, the more noticeably the positive memory appears.

On the other hand, the greater the amount of surfactant in the ink composition is, the more noticeably the negative memory appears. In addition, the greater the heat amount of the heating condition is, the more noticeably the negative memory appears. That is, at a predetermined heating temperature, the longer the heating time is, the more noticeably the negative memory appears. In a predetermined heating time, the greater the heating temperature is, the more noticeably the negative memory appears.

Figure 7:
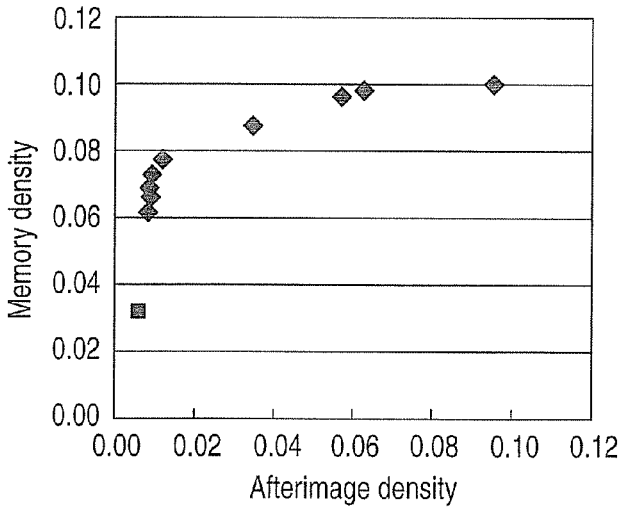
FIG. 7 is a graph illustrating the memory density characteristic as a function of the ink afterimage density which exhibits positive memory.
Figure 8:
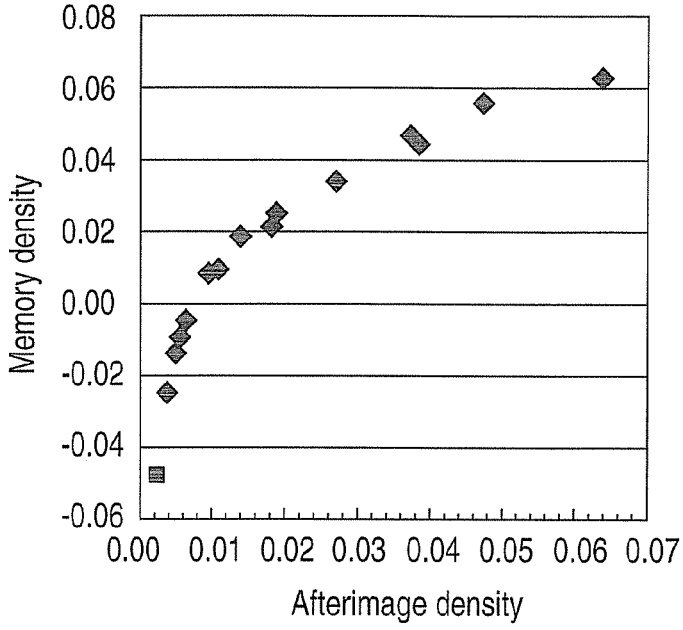
FIG. 8 is a graph illustrating the memory density characteristic as a function of the ink afterimage density which exhibits negative memory.

FIG. 7 is a graph illustrating a memory density characteristic as a function of an ink afterimage density which exhibits positive memory. FIG. 8 is a graph illustrating a memory density characteristic as a function of an ink afterimage density which exhibits negative memory.

Both of FIGS. 7 and 8 show that the memory density characteristic as a function of the afterimage density (the characteristic indicated by plotting rhombi in FIGS. 7 and 8) is represented by a curve. Note that the square plotted in each of FIGS. 7 and 8 indicates the result of heating and erase performed at a sufficiently high temperature for a sufficient time using not the heat rollers but a heating plate as the heating mechanism. This value is assumed to be close to the achievement limit of the density change caused by heating.

In the positive memory ink having the characteristic shown in FIG. 7, it is difficult to reduce the memory density to a level less than or equal to the upper limit of the hard-to-recognize region (for example, −0.02 to 0.02) by additional heating after the afterimage density has reached the invisible region (for example, 0.01 or less).

In the negative memory ink having the characteristic shown in FIG. 8, the memory density changes to a level less than the lower limit of the hard-to-recognize region upon additional heating after the afterimage density has reached the invisible region (for example, 0.01 or less). It can be said that both inks are hard to apply from the viewpoint of simultaneously solving the problems of the afterimage density and the memory density. It has been found out by evaluating various ink compositions that the positive memory is a kind of afterimage that cannot be detected based on the image density because it is in the invisible region, and the negative memory is the negative shift of the memory density characteristic as a function of the afterimage density which occurs because the surfactant acting as the decolorant is excessively present in the ink.

Figure 9:
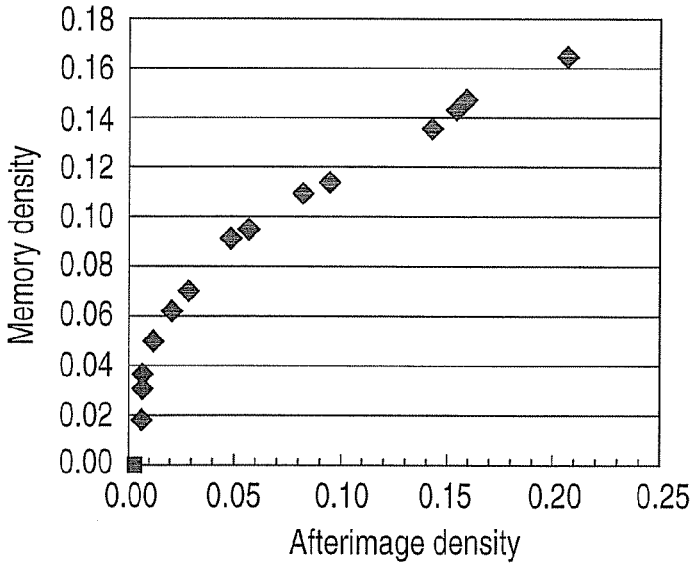
FIG. 9 is a graph illustrating an example of the memory density characteristic as a function of the afterimage density.

FIG. 9 shows an example of the memory density characteristic as a function of the afterimage density. As can be seen, the memory density falls within the hard-to-recognize region (for example, −0.02 to 0.02) upon appropriate additional heating after the afterimage density has reached the invisible region (for example, 0.01 or less). On the other hand, caution is needed for the shift of the memory density characteristic as a function of the afterimage density caused by the difference in the original image density. It has been found out from various evaluation data that the memory density shifts in the negative direction when the original image density lowers.

Figure 10:
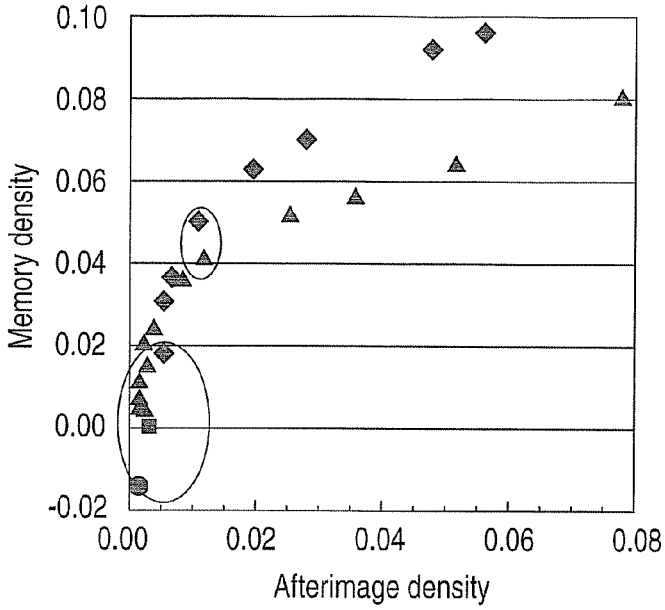
FIG. 10 is a graph showing an afterimage density and a memory density as an erase result of images having different densities.

FIG. 10 is a graph that plots triangles to show the result obtained by similarly evaluating the ink having the characteristic shown in FIG. 9 when the image density of the original image is about ⅔. FIG. 10 shows a region R where the afterimage density and the memory density yield a desirable erase result. Because of the characteristic shift by the original image density as shown in FIG. 10, excessive heating processing may make the afterimage density and the memory density stray outside the optimum range. For this reason, heating processing in the image erasing apparatus needs to be executed under a necessary and sufficient condition.

Figure 11:
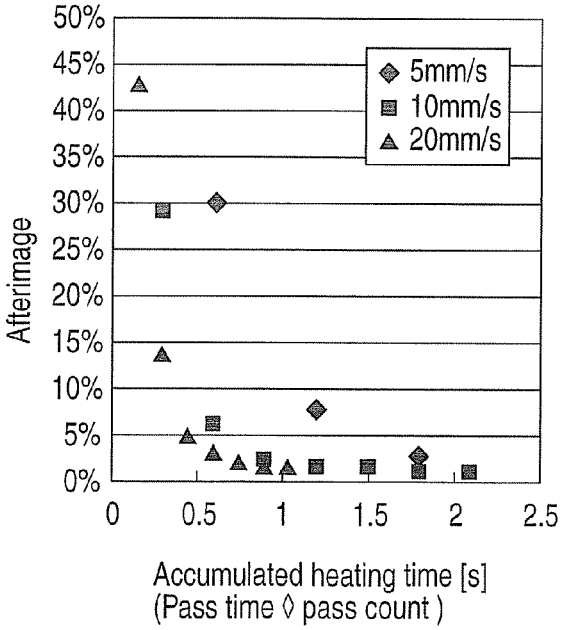
FIG. 11 is a graph showing the result of experiments concerning the effectiveness of multiple heating.

FIG. 11 is a graph showing the result of experiments concerning the effectiveness of multiple heating. The experimental result shown in FIG. 11 indicates that if the heating time for erase is equal, the method of performing heating a plurality of times is conspicuously advantageous for improving the erase characteristic. In the experiments shown in FIG. 11, the afterimage density is evaluated while changing the conveyance speed and pass count of the paper sheet that passes through the heating roller pair (heat rollers having a nip of 3 mm). The experimental result shown in FIG. 11 reveals that the pass count improves the erase characteristic more effectively than the total heating time.

That is, according to the experimental result shown in FIG. 11, the afterimage is rated as thinner when the image is erased by heating the paper sheet several times in a short time rather than by slowly heating if the total heating time is equal. The reason is assumed to concern the heat cycle of a rise and fall in temperature. Hence, in heating control of the paper sheet using the homogeneous dye ink, pass count control seems to be more advantageous for improving the erase characteristic than conveyance speed control. For this reason, the image erasing apparatus of this embodiment efficiently erases an image by controlling the pass count of the heating roller pair.

According to the above-described experiments that change the heating time, the pass count (heating count), or the conveyance speed, the afterimage density and the memory density seem to have a correlation. For example, according to the above-described experimental result, both the afterimage density and the memory density change upon heating control of the paper sheet. If the density of the image erased for the first time is constant, the afterimage density and the memory density can be plotted as a curve. Consequently, in the homogeneous dye ink, the afterimage density and the memory density do not seem to be independent parameters.

The image erasing apparatus of this embodiment is an inline heating-type image erasing apparatus that erases the afterimage to the invisible level and also reduces the memory density to the hard-to-recognize level by appropriately performing necessary and sufficient heating processing for a printed image in consideration of the above-described characteristic of the homogeneous dye ink. The image erasing apparatus of this embodiment can reduce the memory phenomenon as the problem unique to the homogeneous dye ink and efficiently erase (decolor) an image.

More specifically, the image erasing apparatus of this embodiment performs heating processing more than the heating conditions for nonvisualizing the afterimage density so as to make the memory density fall within the adequate range but does not heat the paper sheet more than necessary so as not to induce negative memory. For this purpose, the image erasing apparatus of this embodiment adopts the method of heating the paper sheet a plurality of times.

Figure 12:
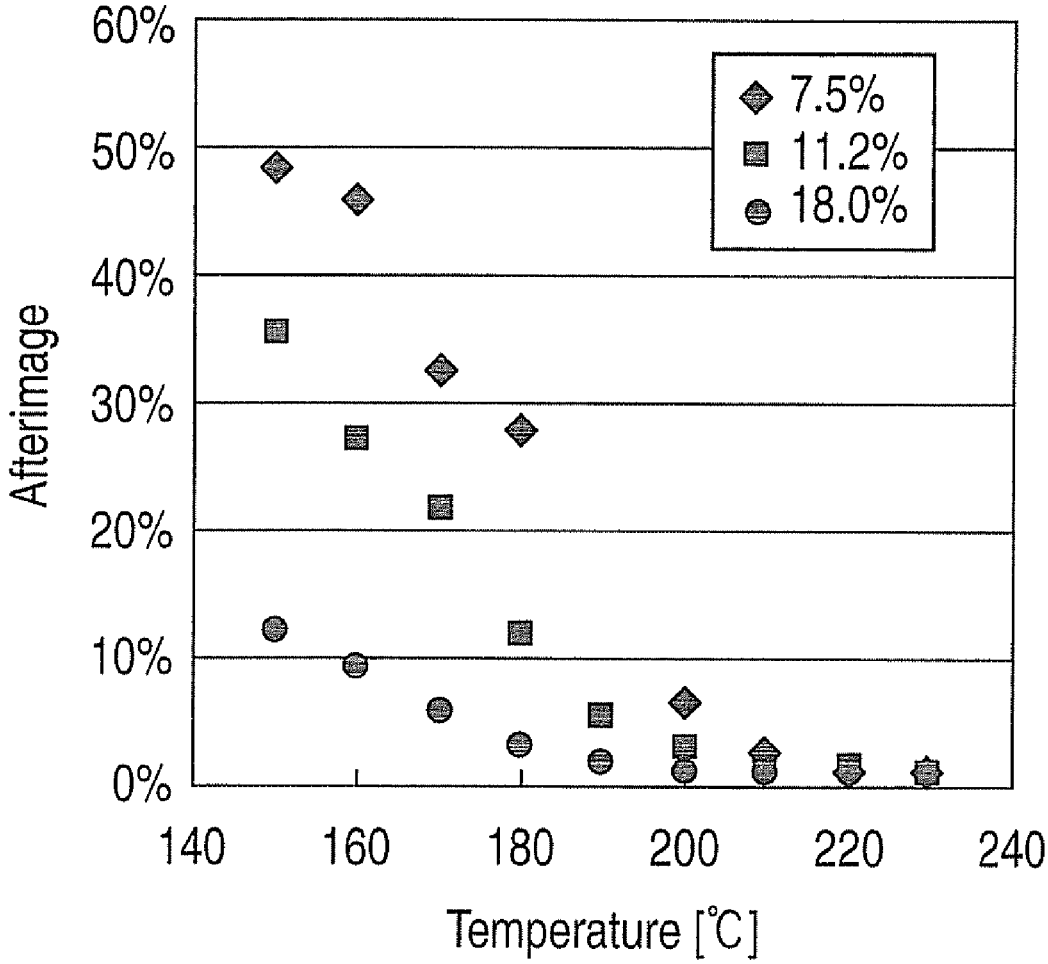
FIG. 12 is a graph showing the result of experiments concerning the effectiveness of humidity control of paper.

Lowering the heating temperature is an important factor from the viewpoint of both energy and damage to the paper sheet. FIG. 12 is a graph showing the result of experiments concerning the effectiveness of humidity control (humidity control effect) of paper. The experimental result shown in FIG. 12 indicates that making the paper sheet absorb moisture before heating (humidifying the paper sheet before heating) allows to obtain an effect greater than or equal to that obtained by raising the heating temperature of the heating roller pair (heat rollers) by 10 to 20° C. Hence, a humidity control roller pair serving as a humidity control mechanism may be provided at the preceding stage of the heating roller pair, as in the image erasing apparatus 40 of the third arrangement example shown in FIG. 4.

Image erase processing for a paper sheet by the above-described image erasing apparatus will be described next.

Figure 13:
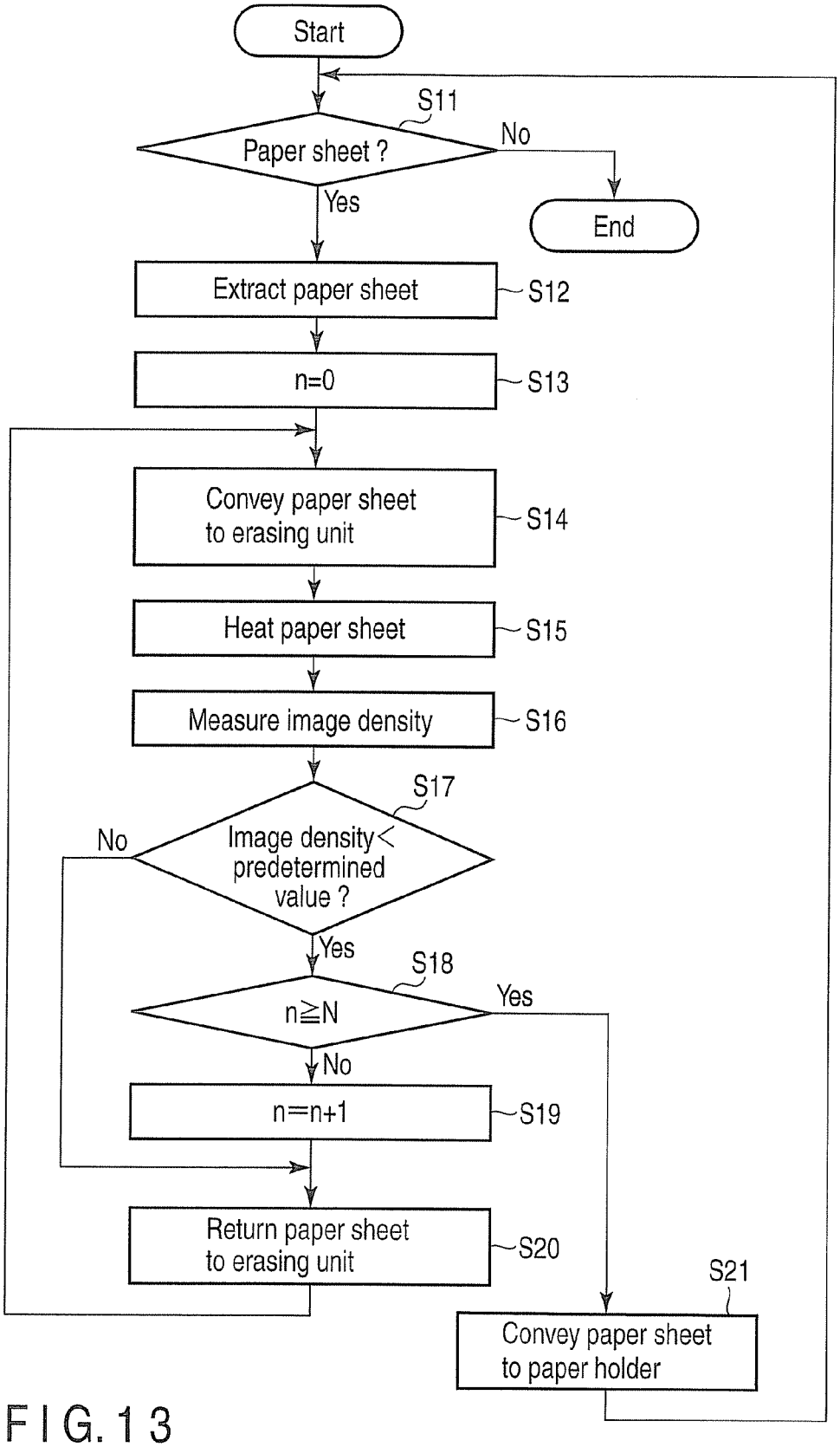
FIG. 13 is a flowchart illustrating the procedure of image erase processing.

FIG. 13 is a flowchart for explaining the procedure of image erase processing.

The image erase processing shown in FIG. 13 is applicable to all the image erasing apparatuses 20, 30, and 40. The image erase processing is executed under the control of the controller of the image erasing apparatus. The description will be made assuming image erase processing by the image erasing apparatus 20.

In the image erasing apparatus 20, the controller 28 first determines whether a paper sheet is present in the paper stocker 21 (step S11). If no paper sheet is present in the paper stocker 21 (NO in step S11), the controller 28 ends the image erase processing. If a paper sheet is present in the paper stocker 21 (YES in step S11), the controller 28 causes the extraction roller 21*a* to extract one paper sheet from the paper stocker 21 (step S12).

When the extraction roller 21*a* extracts the paper sheet, the controller 28 initializes a variable n (step S13). As the initialization processing of the variable n, the controller 28 sets the variable n to zero (n=0). The variable n is a value representing the number of times of passage through the erasing unit (heating roller pair 23) after the afterimage density on the sheet surface has fallen below a predetermined value. After the afterimage density on the sheet surface has fallen below the predetermined value, the variable n is incremented every time the paper sheet returns to the erasing unit (heating roller pair 23).

The paper sheet extracted by the extraction roller 21*a* is conveyed to the heating roller pair 23 serving as the erasing unit by the conveyance rollers 22*b* and 22*c* and the like serving as the main conveyance path. Note that the image erasing apparatus 30 of the second arrangement example conveys the paper sheet extracted from the paper stocker 31 to the humidity control roller pair 39. The image erasing apparatus 40 of the third arrangement example conveys the paper sheet extracted from the paper stocker 41 to the heating roller pair 43A.

The controller 28 causes the heating roller pair 23 to heat the paper sheet (step S15). The controller 28 controls to heat the paper sheet at a predetermined conveyance speed (heating time) and a predetermined heating temperature. For example, the heating roller pair 23 is controlled to a predetermined heating temperature of 140 to 250° C. The paper sheet heated by the heating roller pair 23 is further conveyed. The reflectance measuring system 24 measures the image density (afterimage density) on the sheet surface heated by the heating roller pair 23 (step S16). For example, the reflectance measuring system 24 measures the maximum value of the afterimage density on the sheet surface. The controller 28 compares the maximum value of the afterimage density measured by the reflectance measuring system 24 with the preset threshold D (step S17). The threshold D for the afterimage density is, for example, 0.01.

If the afterimage density measured by the reflectance measuring system 24 is greater than or equal to the threshold D (NO in step S17), the controller 28 controls the sorting guide 25 to convey the paper sheet to the feedback conveyance path (step S20). The sorting guide 25 thus guides the paper sheet to the feedback conveyance path. The feedback conveyance path conveys the paper sheet to the preceding stage of the heating roller pair 23 serving as the erasing unit. In this case, the controller 28 executes the processing from step S14 again without changing the variable n. When the variable n represents the number of times the afterimage density lower than the threshold has continuously been detected, the controller 28 may initialize the variable n every time the afterimage density is determined to be greater than or equal to the threshold.

Note that in the image erasing apparatus 30 of the second arrangement example, the paper sheet guided by the sorting guide 35 is conveyed on the feedback conveyance path to the preceding stage of the humidity control roller pair 39. In the image erasing apparatus 40 of the third arrangement example, the paper sheet guided by the sorting guide 45 is conveyed to the point between the heating roller pairs 43A and 43B.

If the afterimage density measured by the reflectance measuring system 24 is lower than the threshold D (YES in step S17), the controller 28 determines whether the variable n representing the number of times the paper sheet whose afterimage density is lower than the threshold has passed through the heating roller pair 23 is greater than or equal to a predetermined number N (step S18). The predetermined number N is set in accordance with the ink characteristic and heating conditions. For example, the predetermined number N is set based on an experimental result.

If the variable n is less than the predetermined number (NO in step S18), the controller 28 increments the variable n (n=n+1) (step S19) and controls the sorting guide 25 to convey the paper sheet to the feedback conveyance path 26 (step S20). The controller 28 counts the number of times of heating for the paper sheet whose afterimage density is lower than the threshold by incrementing the variable n.

If the variable n is greater than or equal to the predetermined number (YES in step S18), the controller 28 controls the sorting guide 25 to convey the paper sheet to the paper holder 27 (step S21). When the sorting guide 25 guides the paper sheet to the paper holder 27, the conveyance rollers 22*d* to 22*f* serving as the main conveyance path convey the paper sheet to the paper holder 27. When the paper sheet is conveyed to the paper holder, the controller 28 returns to step S11 to determine whether the next paper sheet to be subjected to image erase processing is present in the paper stocker 21. If a paper sheet is present in the paper stocker 21, the controller 28 executes the processing from step S12 again. If no paper sheet is present in the paper stocker 21, the controller 28 ends the image erase processing.

As described above, to erase an image printed by a decolorable homogeneous dye ink by heat, the image erasing apparatus of this embodiment repetitively passes a paper sheet through the erasing unit until the afterimage density on the sheet surface falls below a predetermined threshold. In addition, after the afterimage density on the sheet surface has fallen below the predetermined threshold, the apparatus passes the paper sheet through the erasing unit a predetermined number of times. According to the image erasing apparatus of the embodiment, it is possible to nonvisualize the afterimage and reduces the memory phenomenon. As a result, reuse of paper can be prompted.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image erasing apparatus for decoloring an image printed on a paper sheet using an ink containing at least a leuco dye, a developer, water, a water-soluble organic solvent, and a surfactant, comprising:

a heating unit configured to heat the paper sheet;

a feedback mechanism configured to supply the paper sheet heated by the heating unit to the heating unit again; and a control unit configured to cause the feedback mechanism to supply the paper sheet to the heating unit a plurality of times so as to heat the paper sheet a plurality of times.

2. The apparatus according to claim 1, further comprising:

a measuring unit configured to measure an image density on the paper sheet heated by the heating unit, and wherein the control unit causes the feedback mechanism to resupply the paper sheet whose image density measured by the measuring unit has fallen below a threshold to the heating unit a predetermined plurality of times.

3. The apparatus according to claim 1, further comprising:

a humidity control unit configured to humidify the paper sheet at a preceding stage of the heating unit, and wherein the feedback mechanism conveys the paper sheet humidified by the humidity control unit and then heated by the heating unit to the humidity control unit again.

4. The apparatus according to claim 2, further comprising:

a humidity control unit configured to humidify the paper sheet at a preceding stage of the heating unit, and wherein the feedback mechanism conveys the paper sheet humidified by the humidity control unit and then heated by the heating unit to the humidity control unit again.

5. The apparatus according to claim 1, wherein the heating unit comprises a plurality of heating mechanisms, and the control unit controls the feedback mechanism so that the heating mechanisms heat the paper sheet a predetermined plurality of times.

6. The apparatus according to claim 2, wherein the heating unit comprises a plurality of heating mechanisms, and the control unit controls the feedback mechanism so that the heating mechanisms heat the paper sheet a predetermined plurality of times.

7. The apparatus according to claim 3, wherein the heating unit comprises a plurality of heating mechanisms, and the control unit controls the feedback mechanism so that the heating mechanisms heat the paper sheet a predetermined plurality of times.

8. An image forming apparatus, comprising:

a storage unit configured to store paper sheets;

an extraction mechanism configured to extract one paper sheet from the storage unit;

an image forming unit configured to form an image on the paper sheet extracted by the extraction mechanism using an ink containing at least a leuco dye, a developer, water, a water-soluble organic solvent, and a surfactant;

a heating unit configured to heat the paper sheet having the image formed by the image forming unit;

a feedback mechanism configured to supply the paper sheet heated by the heating unit to the heating unit again; and a control unit configured to cause the feedback mechanism to pass the paper sheet to the heating unit a plurality of times and then store the paper sheet in the storage unit.

* * * * *